US005967498A

United States Patent [19]

Junell

[11] Patent Number: 5,967,498

[45] Date of Patent: Oct. 19, 1999

[54] MODULAR FIBERGLASS RAILING SYSTEM

[76] Inventor: Jack S. Junell, 10014 64th Pl. West, Mukilteo, Wash. 98275

[21] Appl. No.: 08/932,855

[22] Filed: Sep. 18, 1997

Related U.S. Application Data

[60] Provisional application No. 60/026,270, Sep. 18, 1996.

[51] Int. Cl.[6] ..... E04H 17/14

[52] U.S. Cl. ..... 256/19; 256/59; 256/65

[58] Field of Search ..... 256/59, 65, 19, 256/24, 25, 26, 22

[56] References Cited

U.S. PATENT DOCUMENTS

| | | | |
|---|---|---|---|
| 1,791,680 | 2/1931 | Miller | 256/22 X |
| 1,936,109 | 11/1933 | Frank | 287/53 |
| 2,590,929 | 4/1952 | Bush | 256/22 |
| 3,648,981 | 3/1972 | Allen | 256/59 X |
| 3,770,245 | 11/1973 | Murdock | 256/24 |
| 4,146,212 | 3/1979 | Lermer | 256/59 X |
| 4,150,907 | 4/1979 | Thurnauer | 403/234 |
| 4,477,059 | 10/1984 | Willis | 256/65 |
| 4,498,660 | 2/1985 | Brema et al. | 256/19 |
| 4,600,179 | 7/1986 | Willets | 256/67 |
| 4,723,760 | 2/1988 | O'Sullivan | 256/65 X |
| 4,767,232 | 8/1988 | Francis | 403/91 |
| 4,927,930 | 5/1990 | Chung | 256/67 |
| 4,982,933 | 1/1991 | Schultz | 256/65 |
| 5,026,028 | 6/1991 | Ooi et al. | 256/67 |
| 5,100,107 | 3/1992 | Latta | 256/19 |
| 5,215,290 | 6/1993 | Khalessi | 256/19 |
| 5,382,001 | 1/1995 | Lichti | 256/59 X |
| 5,443,244 | 8/1995 | Gibbs | 256/22 |
| 5,755,431 | 5/1998 | Williams | 256/19 |

FOREIGN PATENT DOCUMENTS

| | | | |
|---|---|---|---|
| 74033 | 11/1944 | Czechoslovakia . | |
| 381289 | 8/1990 | European Pat. Off. | 256/24 |
| 584560 | 2/1925 | France . | |

*Primary Examiner*—Harry C. Kim
*Attorney, Agent, or Firm*—Todd N. Hathaway

[57] ABSTRACT

A railing system constructed primarily of high-strength, high-durability molded fiberglass. There are upper and lower box-section rail members which are joined by vertically extending tubular uprights, with a plastic stringer rod being threaded through bores in the ends of the uprights to lock the members together. Socket members are provided for mounting the ends of the rail members to a vertical support surface, and strut members are provided for installation between the lower rail member and the underlying floor/deck surface. The components are modular for ease of assembly, and the use of plastic materials not only obviates maintenance requirements but also enables the assembly to be cut to length and installed using conventional woodworking saws and other simple, readily available hand tools.

12 Claims, 5 Drawing Sheets

36
38
12
34a
32
30
76a
74
16
16'
70
72
38
34b
36
14
76b

MODULAR FIBERGLASS RAILING SYSTEM

This application claims benefit of provisional application No. 60,026,270 filed Sep. 18, 1996.

BACKGROUND a. Field of the Invention

The present invention relates generally to safety railings, and more particularly, to a modular railing system constructed of high-strength fiberglass which is particularly adapted to installation along the edges of balconies, decks, and similar structures.

b. Background Art

Conventional deck and balcony railing systems exhibit a number of serious deficiencies. Although wood, metal, and vinyl are all used in the industry, each of these materials has its own set of problems.

For example, wood is perhaps the most commonly used material. Although it enjoys the advantages of traditional appearance, fabrication of a wood railing is typically a labor-intensive process, involving cutting the various pieces and nailing them together. On the other hand, although certain wooden "pre-fab" railings are available, the need for manufacturing economy means that most of these are rickety structures which are assembled using nail guns or staples; not only does this insubstantial construction cause poor long term durability, it can in some cases lead to weakness and potential safety problems. Moreover, wood railings must be painted, stained, or otherwise preserved against weathering/rot, and the preservative must be reapplied on a periodic basis, at considerable expense to the property owner.

Metal railings, by comparison, generally exhibit high strength, but tend to be very expensive. Also, the material is very difficult to work with in the field, requiring special equipment for cutting/welding the metal, which adds greatly to cost. Furthermore, the weight which is inherent in most metal railings is another complicating factor. Still further, although some metals (e.g., extruded aluminum) are less prone to oxidation than steel or other ferrous materials, virtually all metals still require some form of coating to prevent long term corrosion.

Vinyl railings enjoy some advantages over wood and metal in terms of maintenance, but they typically exhibit poor strength and surface wear characteristics. Also, the aesthetic qualities of vinyl railings generally render them unsuitable for use in quality construction.

Accordingly, there exists a need for a railing system which exhibits high strength and great durability in an exposed environment, yet which is inexpensive to manufacture and easy to install with a minimum of labor. Furthermore, there is a need for such a railing system which can be installed using a few basic tools, rather than requiring special welding and cutting equipment. Moreover, there exists a need for such a railing system which does not require periodic painting or other preservative treatment. Still further, there is a need for such a railing system in which the appearance and tactile qualities of the materials employed give the product a high degree of aesthetic appeal.

SUMMARY OF THE INVENTION

The present invention has solved the problems cited above, and is a railing system constructed primarily of high-strength, high-durability molded fiberglass. There are upper and lower box section rail members which are joined by vertically extending tubular uprights at spaced apart locations, in the manner of a balustrade. The upper and lower ends of the uprights extend through openings and into the hollow interior of the upper and lower rail members, and are retained therein by a longitudinal rod member which is threaded through bores in the ends of the uprights. Socket members are provided for mounting the ends of the upper and lower rail members to a wall or other vertical support surface. A strut member is provided for installation between the lower rail member and the floor surface, to provide vertical support where needed.

Because all major components are formed of fiberglass tubing or plastic materials, the assembly can be cut to length and installed using conventional woodworking tools. Also, the system does not require any painting or other periodic maintenance.

In some embodiments, one or more panes of glass may be installed between the upper and lower rail members, with the vertical edges of the panes being retained in special, slotted upright members.

There is also provided a support post assembly in which the lower end of the post forms a sleeve structure which fits over an enclosed support base member. The base member has an upper portion similar to a vertically extending I-beam, with the base having a cutaway area to permit the hold down screws to be installed closer to the centerline of the support. The base member is preferably formed of molded plastic, as are the rail-end socket members.

Broadly, the invention is a railing structure comprising spaced-apart upper and lower rail members, each rail member being formed of high strength molded fiberglass and having a hollow core, a series of upright support members mounted between the upper and lower rail members, each support member having upper and lower ends which extend into the hollow cores of the rail members, and at least one elongate rod member which extends through at least one of the hollow cores in the rail members and is threaded through bores formed in the ends of the upright members which exted therein so as to lock the support members in engagement with the rail member.

DETAILED DESCRIPTION

Figures 1, 2:
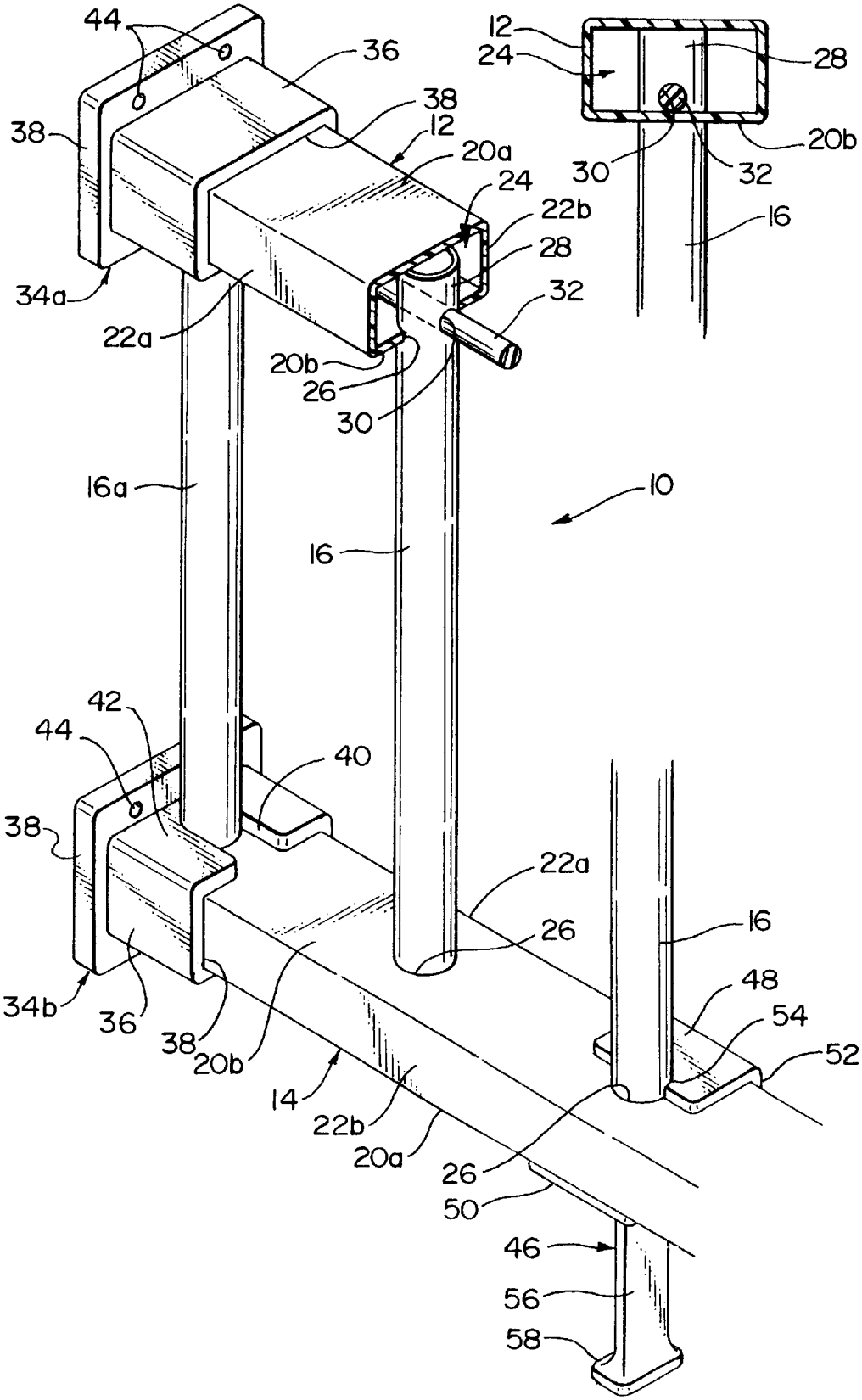
FIG. 1 is a perspective view, partially in cutaway, of a railing system in accordance with the present invention, where one end of this mounts to a wall or other vertical surface.
FIG. 2 is an end view of a cross-section taken through the upper rail of the system shown in FIG. 1, showing the manner in which the upper ends of the uprights are retained in the rail member by an elongate rod which passes through the ends thereof.

As can be seen in FIG. 1, the railing system 10 in accordance with the present invention includes upper and lower generally parallel rail members 12 and 14, which are joined by a plurality of spaced apart, vertically extending upright members 16, in a manner somewhat similar to a balustrade. The upper and lower rail members are substantially identical, one being inverted relative to the other. Each is a box-section member having a rectangular cross-section, with relatively wide horizontal wall portions 20*a,* 20*b* joined by relatively vertically extending side walls 22*a,* 22*b,* so that each rail member forms a hollow rectangular core area 24. As will be described in greater detail below, the rail and upright members are both preferably formed of high-grade, high-strength pultrusion molded fiberglass; in addition to its inherent strength, this material (as well as the molded fiberglass material of the upright members) has an aesthetic aspect which resembles painted wood, and is far superior to that of vinyl or similar materials.

A series of circular holes 26 or similar openings are formed in the opposing walls 20*b* of the upper and lower rail members 12, 14 at evenly spaced apart distances, e.g., at 5 inch centers. The openings are sized to receive the tubular uprights 16, so that the end portions 28 thereof extend into the hollow core area 24 of each rail member (see also FIG. 2). A hole or bore 30 extends through the end portion of each upright 16. The bores are formed at the same spaced distance from the end of each upright 16, which is selected so that the bores 30 will be axially aligned with one another and positioned just inside of and adjacent to the wall portion 20*b* of the rail member. A straight stringer rod 32, preferably formed of PVC or other suitable plastic material, is threaded through the aligned bores 30 to secure the ends of the uprights 16 within the rail member; use of a substantially rigid, yet somewhat resiliently flexible plastic rod material for this purpose provides the railing with excellent stability and also eases the assembly process. The position of the bores 30, in tangential contact with the inner surface of the wall 20*b,* ensures that the rod member 32 extends in contact with the inner surface of the wall portion so as to form a tight engagement therewith. The butt ends of the uprights, in turn, engage the inside of the opposite wall of the rail members, and this serves to eliminate any possibility of "slop" in the assembly.

Although the exemplary embodiment which is illustrated in the figures shows the rail members extending in a horizontal direction, with the upright supports being mounted perpendicular thereto, it will be understood that the assembly can also be configured to run at an angle, such as for use along stairs, for example. This is accomplished by drilling the openings and bores in the railings and upright supports at the necessary angles, and also angle-cutting the butt ends of the uprights.

The construction described above provides a rigid, highly stable structure, while presenting a clean external appearance with an absence of visible fasteners. Also, as was noted above, the lower rail member, including its internal structure, is essentially identical to the upper member which is shown in FIG. 2, except that it is in an inverted position.

The ends of the upper and lower rail members 12, 14 are received in upper and lower wall sockets 34*a,* 34*b,* which are again essentially identical units in inverted positions. Each wall socket has a horizontally extending, rectangular sleeve portion 36 and a base flange portion 38. The rectangular sleeve portion 36 forms a rectangular socket area 38 having internal dimensions which closely match the external dimensions of the rail members, so that the ends of the rail members are received therein in a tightly-nested, close fitting relationship. An elongate, semicircular-ended slot area 40 is formed in one of the horizontal wall portions 42 of each sleeve portion to accommodate the end of one of the uprights 16 therein, so as to enable the upright to be positioned closely adjacent to the base flange 38.

The base flange portion 38 of each socket member 34 provides a generally planar surface, which extends normal to the axis of the sleeve portion 36, for mounting flush against a wall or other vertical surface. A plurality (e.g., four) bores 44 are provided for screws or other fasteners for attaching the socket members to the wall surface.

A strut member 46 is also provided, for those installations where the railing system bridges large gaps between adjacent walls or other supports. Each strut member has a three-sided jaw area which is formed by upper and lower horizontal flange portions 50 and a vertical connecting wall portion 52. As is shown in FIG. 1, these flange and wall portions are configured to engage three sides of the lower rail member 14; the lower flange 50 extends the entire width of the rail member so as to provide upwardly directed support all the way across the bottom surface thereof, while the upper flange portion 48 extends approximately one-half way across the upper surface and has a semicircular cutout area for accommodating an upright 16 therein. A vertical strut portion 56 extends downwardly from the lower flange member 50, and terminates in a horizontal foot portion 58 which rests against the horizontal surface of the deck or other floor surface so as to provide support for the railing.

Figure 3:
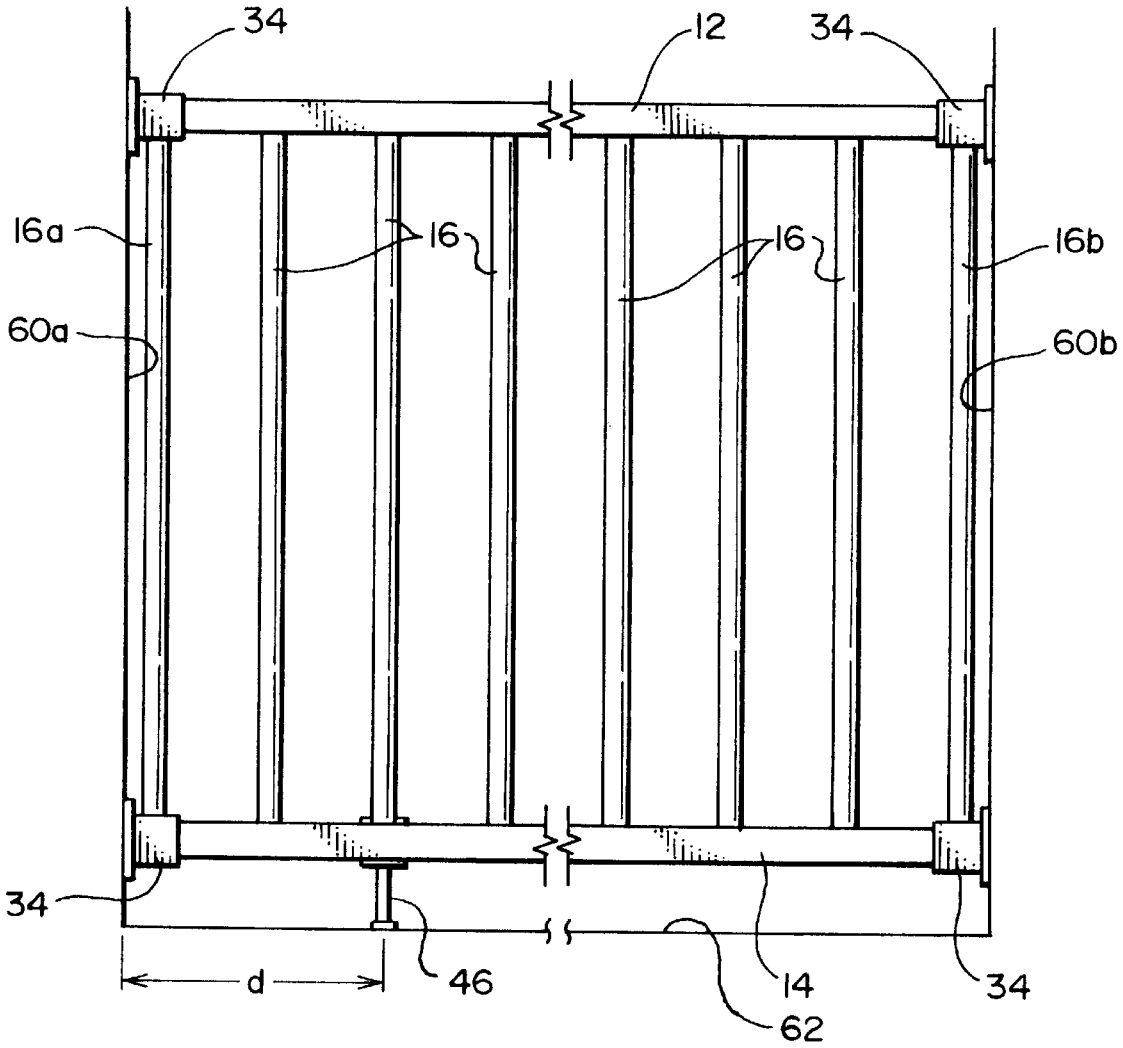
FIG. 3 is an elevational view of the railing system of FIG. 1, showing this installed across a gap between first and second walls or other vertical support surfaces.

Accordingly, as can be seen in FIG. 3, the railing 10 system can be cut to length and mounted by wall sockets 34 so as to span the gap between first and second walls 60*a,* 60*b* or other vertical supports. The strut member 46 is optionally installed between the lower rail member 14 and the deck or other floor surface 62, at a distance "d" from the wall support which is selected to give the railing sufficient rigidity when subjected to predetermined vertical loads, such as, for example, a person stands on the lower rail member. For example, a suitable distance "d" for a typical installation using the exemplary materials described herein may be approximately 10–12 feet.

Because the railing members 12, 14, and the internal stringer rod 32 are all constructed of materials (i.e., pultrusion molded fiberglass and PVC rod) which can be easily cut using conventional wood cutting tools, such as electric power saws, the fully assembled railing system can be economically supplied in standard lengths which are then conveniently cut to length at the work site. To install the embodiment which is illustrated, the upper and lower rails are cut ½ inch shorter than the gap between the first and second walls 60*a,* 60*b,* to accommodate the combined thickness of the base flanges 38. The socket members 34 are then slid onto the ends of the rail members, with the slot areas 40 accommodating any uprights which may happen to be near to the ends of the rail members at the length to which they are cut. The socket members are then screwed/bolted to the walls 60*a,* 60*b,* and the strut member 46 is installed (if required), with the semicircular cutout 54 accommodating the upright member 16 at the installation point in a manner analogous to the slot areas 40 in the socket members.

Suitable materials for forming the components of the exemplary embodiment of the railing system 10 which is shown herein includes the following:

Upper and lower box section rail members—2¾"×1½" rectangular pultrusion molded fiberglass; 1/16" wall thickness Tubular upright members—1" OD pultrusion molded tubular fiberglass; 3/32" wall thickness Stringer rod—⅜" OD solid PVC rod Socket members—injection molded UV stable ABS plastic; 3¼"×3½" base flange; 2" sleeve portion with 3/16" wall thickness Strut members—UV stable injection molded ABS plastic; 3/16" thickness wall members; 3¾" strut height Other suitable plastics having sufficient strength and durability may be substituted for the injection molded ABS plastic noted above. With the exception of the enclosed PVC stringer rod, all materials should be UV stable to provide long service life. The materials can be molded in any color which may be desired to match or compliment the exterior decor of the structure; for example, all white components can be used in many installations (with white-painted screws) to provide attractive railings which do not require any painting during installation or for maintenance. Also, the exemplary dimensions given above may be adjusted as desired. A suitable source for the protrusion molded fiberglass is Omega Pultrusions Inc.

Figure 4:
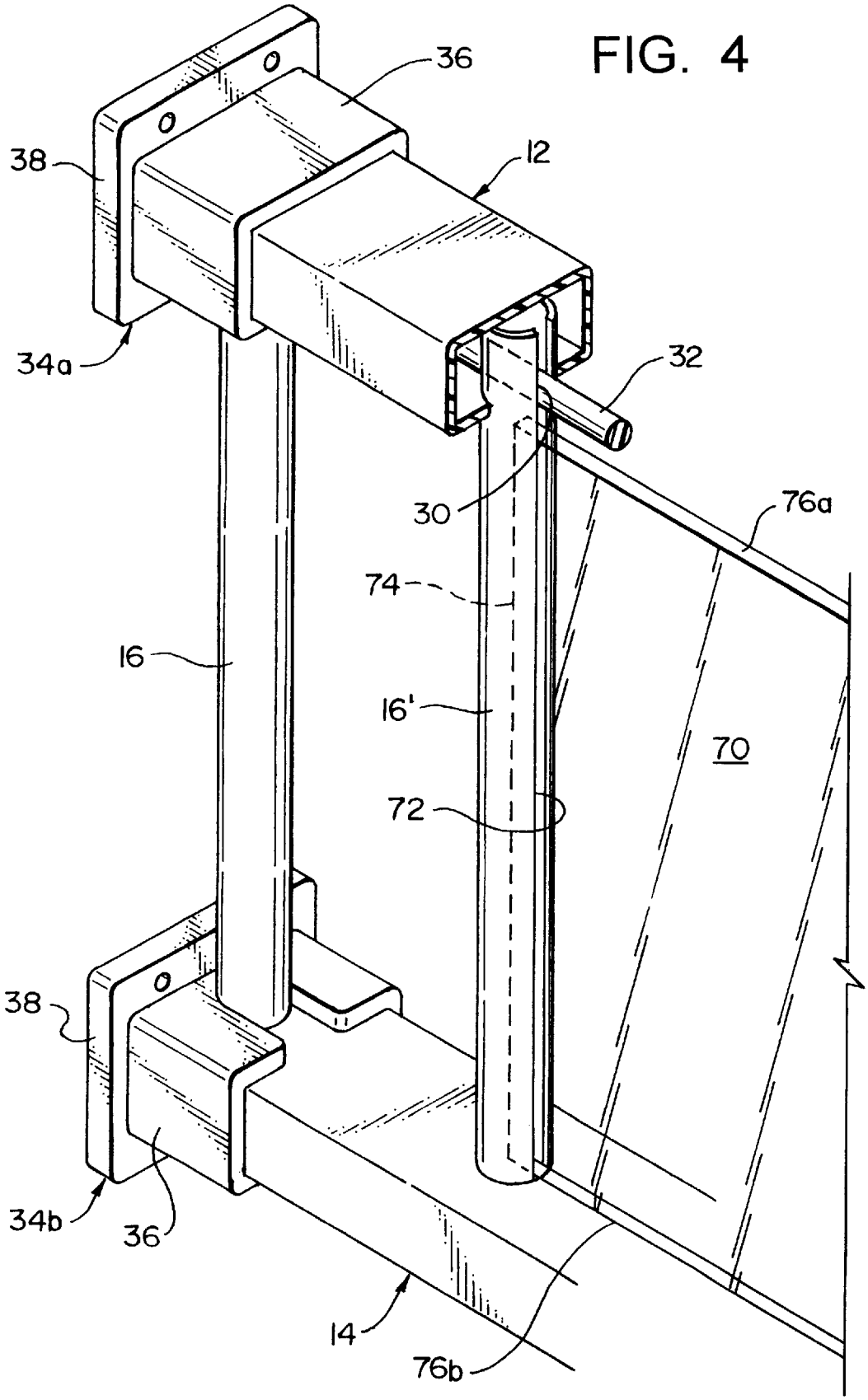
FIG. 4 is a perspective view, partially in cutaway, similar to FIG. 1, but showing a railing system in accordance with the second embodiment of the present invention in which panes of glass are installed between the upper and lower rails, with the edges thereof being retained in the vertically extending uprights.
Figure 5:
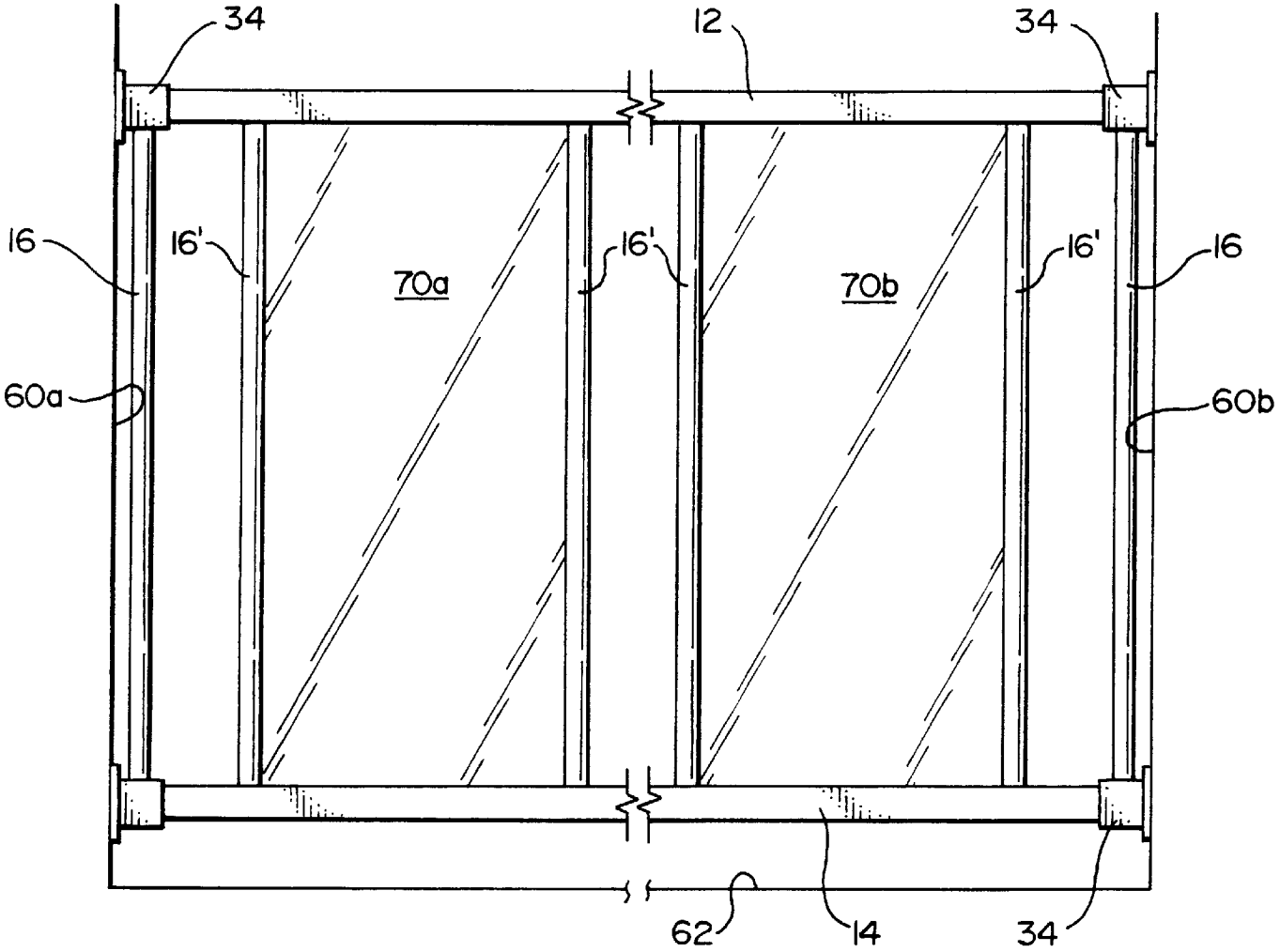
FIG. 5 is an elevational view similar to that of FIG. 3, showing the glass-paned embodiment of the invention installed in the gap between first and second walls or other surfaces/supports.

FIGS. 4–5 show an embodiment of the present invention which is essentially similar to that described above, and in which like reference numerals refer to like components, with the exception that the system includes one or more glass panels 70 which are fitted between the upper and lower rail members 12, 14.

As can be seen in FIG. 4, in this embodiment certain upright members 16' are provided which are cut longitudinally to form vertically extending slot areas 72 for receiving and holding the vertical edges 74 of the glass panes 70. The slot 72 is cut so that this is in alignment with the bores 30 in the upper and lower ends of the uprights 16', so that the rod member 32 can be threaded through these as shown in FIG. 4.

The widths of the glass panes 70 are preferably selected so that these extend from the position of one slotted upright 16' to the next, at standard centers; widths of the glass panels may be 32", 36", 44" etc. The height of the panes, in turn, is selected so that the upper and lower edges 76*a*, 76*b* thereof extend in contact with or closely adjacent to the opposing surfaces 20*b* of the upper and lower rail members 12 and 14, so as to eliminate any significant gaps between the two. The glass used for the panes 70 is preferably heavy grade safety glass which meets standards for a restraining safety barrier.

Figure 6:
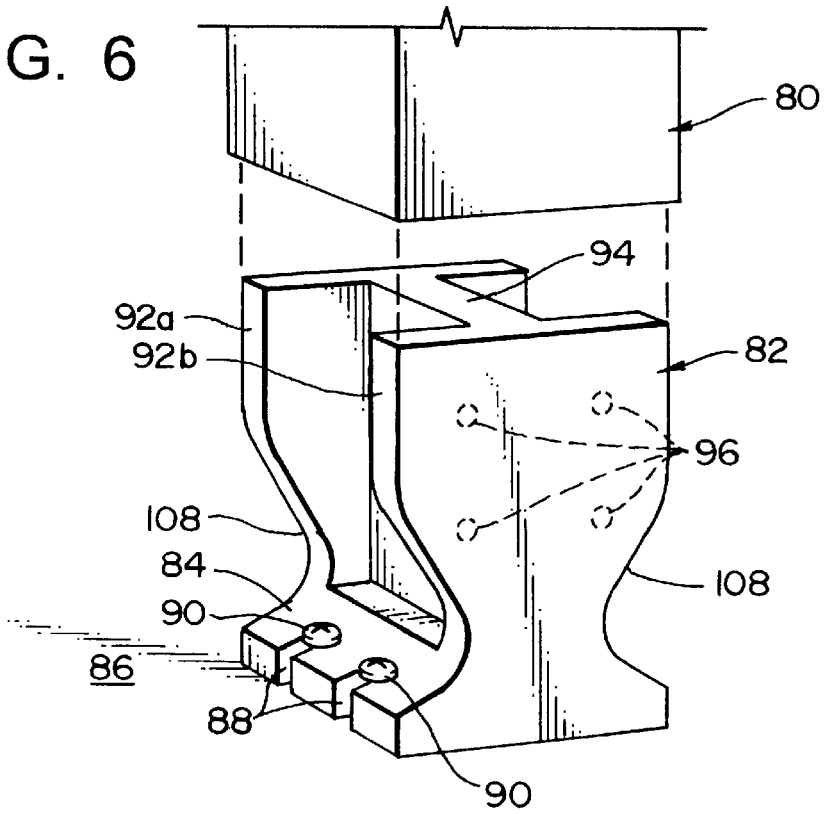
FIG. 6 is a perspective view of the bottom portion of a vertical support post and an internal base unit which is received therein for securing the stanchion to a deck or other floor surface.
Figure 7:
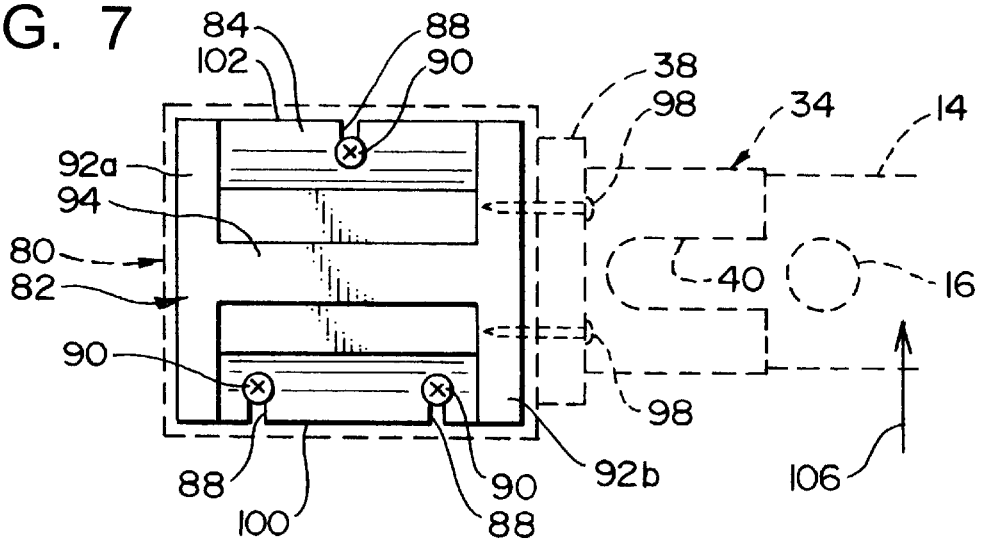
FIG. 7 is a top plan view of the internal base unit of FIG. 6, showing the post and attached rail member in broken line image.

In addition to mounting the railing system to vertical walls or similar structures, the present invention provides a support post which can be mounted at spaced apart locations along the edge of a deck or other floor surface at spaced apart locations, in place of (or between) vertical wall supports. As can be seen in FIG. 6, the support post comprises a square, hollow column portion 80 which fits sleeve-like over an internal base member 82. The member has a base flange 84 which rests flat on top of the deck or other floor surface 86, and which has slots 88 through which screws 90 extend vertically into the floor surface. First and second side flange portions 92*a*, 92*b* extend upwardly from the ends of the base flange, and are joined by a central, vertically extending web portion 94 in a manner similar to an I-beam. As can be seen in FIG. 7, the two side flanges 92 fit tightly within the square interior of the column member 80, while the web portion 94 maintains the rigidity of the structure. The end flanges 92 also provide penetration sites 96 for a plurality of screws 98 which extend through the base flange 38 of a socket member 34 on the end of the rail member 12/14.

Although bores in the base flange may be used in place of the slots 88 which are shown in FIGS. 6–7, the slots have the advantage of facilitating quick and easy installation. Also, as can be seen in FIG. 7, the inner side 100 of the base member 82 (i.e., the side towards the person on the deck or floor) preferably has slots/bores for two hold down screws 90, while the outer side 102 has a slot/bore for just one hold down screw. This provides for a quicker, more economical installation than using four hold down screws, and causes less damage to the underlying concrete or other substrate, yet provides adequate pull out strength on the side of the base flange 84 where this is needed to resist outwardly-directed impact forces and other loads, as indicated by arrow 106 in FIG. 7. Moreover, by using the "I-beam" configuration with cutaway areas 108 near the base, as shown in FIG. 6, it is possible to locate the hold down screws 90 closer to the centerline of the base member, thereby minimizing any mechanical advantage (i.e., leverage) of impact forces tending to pull out the hold down screws.

The base member 82 may be suitably formed of injection molded ABS plastic material, while the upwardly extending support column 80 is preferably formed of the pultrusion molded fiberglass material described above.

It is to be recognized that various alterations, modifications, and/or additions may be introduced into the constructions and arrangements of parts described above without departing from the spirit or ambit of the present invention as defined by the appended claims.

What is claimed is:

1. A non-metallic railing structure comprising:

spaced-apart upper and lower, generally parallel rail members, each said rail member being formed of resiliently flexible molded fiberglass and having a hollow core;

a series of upright support members mounted between said upper and lower rail members, each said support member having an upper end which extends into said hollow core of said upper rail member and a lower end which extends into said hollow core of said lower rail member; and first and second elongate, continuous rod members which extend over substantially a full length of said railing structure, each said elongate rod member being formed of a resiliently flexible material;

said first elongate rod member extending through said hollow core of said upper rail member and being threaded through bores formed in said upper ends of said upright members so that said first rod member extends in substantially continuous abutment with a lower wall of said upper rail member, and said second elongate rod member extending through said hollow core of said lower rail member and being threaded through bores formed in said lower ends of said upright members so that said second rod member extends in substantially continuous abutment with an upper wall of said lower rail member;

so that in response to an outward impact load which received at one of said rail members, said rod members engage said walls of said rail members and flex resiliently therewith, so that said rail members both flex in response to said impact load and thereby cooperate to resist bending of said railing structure by said load.

2. The railing structure of claim 1, wherein said upper and lower rail members have substantially identical rectangular cross-sections.

3. The railing structure of claim 2, wherein said rail members are formed of tubular pultrusion molded fiberglass material.

4. The railing structure of claim 3, wherein said upright members are formed of pultrusion molded fiberglass material.

5. The railing structure of claim 4, wherein each said hollow, pultrusion molded fiberglass rail member has a wall thickness of about 1/16 inch.

6. The railing structure of claim 3, wherein said continuous rod members each comprise:

a solid PVC rod member.

7. The railing structure of claim 6, where each said solid PVC rod member has a diameter of about 3/8 inch.

8. A railing structure comprising:

spaced apart, generally parallel upper and lower rail members, each said rail member being formed of box-section tubular molded fiberglass material having top and bottom walls and first and second side walls which define a hollow core and a generally rectangular cross-section, said bottom wall of said upper rail member having a series of discrete openings formed therein at spaced-apart location, said lower rail member being substantially identical to said upper rail member except for being inverted so that said wall having said series of openings formed therein is opposite and facing said lower wall of said upper rail member;

a series of upright, spaced-apart support members mounted between said upper and lower rail members, said support members being formed of tubular molded fiberglass material and having upper and lower ends which are received in said series of openings in said rail members, said ends of said upright support members extending through said openings into said hollow cores of said rail members;

first and second elongate stringer rods formed of a rigid, resiliently flexible rod material, which extend through said hollow cores of said upper and lower rail members and are threaded through a series of axially-aligned bores formed in said ends of said upright support members so as to lock said series of upright support members in engagement with said rail members, said bores being at a predetermined distance from a butt end of each said support member such that said first and second stringer rods which are threaded therethrough tangentially abut inner surfaces of said facing walls of said upper and lower rail members and said butt ends of said support members abut inner surfaces of walls of said rail members opposite said facing walls thereof;

at least one end bracket member for mounting an end of one of said rail members to an upright support surface, said bracket member having a generally vertically extending base plate portion for mounting said end bracket member flat against said upright support surface, and a generally horizontally extending socket portion having a generally rectangular cross-section for receiving said end of one of said rail members, a cutout area being formed in at least one wall of said socket portion which extends from an open end of said socket portion and is sized to receive one of said upright support members therein so as to permit said upright support member to be positioned closer to said upright support surface than said open end of said socket portion; and at least one strut member for mounting to said lower rail member at a spaced distance from an end thereof, said strut member having a jaw portion formed by top, bottom and side flanges which define a generally rectangular, horizontally extending receiving area for engaging said lower rail member, a cutout area being formed in said upper flange of said jaw portion which extends from a side opening thereof and is sized to receive one of said upright support members therein so as to permit said upper flange to at least partially extend around said support member, a leg portion which extends downwardly from said jaw portion towards a generally horizontal support surface which lies below said lower rail member, and a foot portion formed on a lower end of said leg portion for resting in weight-bearing engagement against said generally horizontal support surface.

9. A railing structure comprising:

spaced-apart upper and lower, generally parallel rail members, each said rail member being a hollow box section member having a generally rectangular cross-section and a hollow core and being formed of high-strength molded fiberglass, said upper and lower said members having substantially identical cross-sections;

a series of upright support members mounted between said upper and lower rail members, each said support member having an upper end which extends into said hollow core of said upper rail member and a lower end which extends into said hollow core of said lower rail member;

at least one elongate rod member which extends through at least one of said hollow cores in said rail members and is threaded through bores formed in said ends of said upright members which extend into said hollow core, so as to lock said series of support members in engagement with at least one of said rail members; and upper and lower end-bracket members for mounting ends of said rail members to an upright support surface, said end bracket members each comprising:

a socket portion having a generally rectangular cross-section for receiving an end of one of said box section rail members;

a base plate portion for mounting said end bracket member flat against said support surface; and a cutout area formed in at least one wall of said rectangular cross-section socket portion of said bracket member, said cutout area extending from an open end of said socket portion and being sized to receive one of said upright support members therein, so as to permit said upright support member to be positioned closer to said upright support surface than said open end of said socket portion.

10. A railing structure comprising:

spaced-apart upper and lower, generally parallel rail members, each said rail member being a hollow, box section member having a generally rectangular cross-section and a hollow core and being formed of high-strength molded fiberglass, said upper and lower said members having substantially identical cross-sections;

a series of upright support members mounted between said upper and lower rail members, each said support member having an upper end which extends into said hollow core of said upper rail member and a lower end which extends into said hollow core of said lower rail member;

at least one elongate rod member which extends through at least one of said hollow cores in said rail members and is threaded through bores formed in said ends of said upright members which extend into said hollow core, so as to lock said series of support members in engagement with at least one of said members; and at least one strut member mounted to said lower rail member at a spaced distance from an end thereof, said strut member comprising:

a jaw portion for engaging said lower rail member, said jaw portion comprising upper, lower and side flange portions which define a generally rectangular receiving area for engaging said rectangular cross-section lower rail member therein;

a leg portion which extends downwardly from said jaw portion to a generally horizontal support surface which lies below said lower rail member; and a cutout area formed in said upper flange portion of said jaw portion, said cutout area extending from a side opening of said jaw portion and being sized to receive one of said upright support members therein so as to permit said upper flange portion to at least partially extend around at least one support member which is mounted in said lower rail member.

11. The railing structure of claim 10, wherein said strut member further comprises:

a foot portion formed on a lower end of said leg portion of said strut member for resting in weight-bearing engagement against said generally horizontal support surface below said lower rail member.

12. A railing structure comprising:

spaced apart, generally parallel upper and lower rail members, each said rail member being formed of box-section tubular molded fiberglass material having top and bottom walls and first and second side walls which define a hollow core and a generally rectangular cross-section, said lower wall having a series of discrete openings formed therein at spaced-apart locations, said lower rail member being substantially identical to said upper rail member except for being inverted so that said wall having said series of openings formed therein is opposite and facing said lower wall of said upper rail member;

a series of upright, spaced-apart support members mounted between said upper and lower rail members, said support members each being formed of tubular molded fiberglass material and having upper and lower ends which are received in said series of openings in said rail members, said ends of said upright support members extending through said openings into said hollow cores of said rail members;

first and second elongate stringer rods formed of rigid, resiliently flexible plastic rod material, which extend through said hollow cores of said upper and lower rail members and are threaded through a series of axially-aligned bores formed in said ends of said upright support members so as to lock said series of upright support members in engagement with said rail members, said bores being formed at a predetermined distance from a butt end of each said support member such that said first and second stringer rods which are threaded therethrough tangentially abut inner surfaces of said facing walls of said upper and lower rail members and said butt ends of said support members abut inner surfaces of walls of said rail members opposite said facing walls thereof;

at least one end bracket member for mounting an end of one of said rail members to an upright support surface, said bracket member having a generally vertically extending base plate portion for mounting said end bracket member flat against said upright support surface, and a generally horizontally extending socket portion having a generally rectangular cross-section for receiving said end of one of said rail members, a cutout area being formed in at least one wall of said socket portion which extends from an open end of said socket portion and is sized to receive one of said upright support members therein so as to permit said upright support member to be positioned closer to said upright support surface than said open end of said socket portion; and at least one strut member mounted to said lower rail member at a spaced distance from an end thereof, said strut member having a jaw portion formed by top, bottom and side flanges which define a generally rectangular, horizontally extending receiving area for engaging said lower rail member, a cutout area being formed in said upper flange of said jaw portion which extends from a side opening thereof and is sized to receive one of said upright support members therein so as to permit said upper flange to at least partially extend around said support member, a leg portion which extends downwardly from said jaw portion to a generally horizontal support surface which lies below said lower rail member, and a foot portion formed on a lower end of said leg portion for resting in weight-bearing engagement against said generally horizontal support surface.

* * * * *